US010264338B2

(12) United States Patent
Humphreys

(10) Patent No.: US 10,264,338 B2
(45) Date of Patent: Apr. 16, 2019

(54) ADJUSTABLE SPEAKER FRAME

(71) Applicant: Tyler Humphreys, Eugene, OR (US)

(72) Inventor: Tyler Humphreys, Eugene, OR (US)

( * ) Notice: Subject to any disclaimer, the term of this patent is extended or adjusted under 35 U.S.C. 154(b) by 232 days.

(21) Appl. No.: 15/483,833

(22) Filed: Apr. 10, 2017

(65) Prior Publication Data

US 2018/0295432 A1 Oct. 11, 2018

(51) Int. Cl.

| | |
|---|---|
| ***H04R 1/32*** | (2006.01) |
| ***H04R 1/02*** | (2006.01) |
| *H04R 1/20* | (2006.01) |
| *H04R 1/34* | (2006.01) |

(52) U.S. Cl.

CPC ..... *H04R 1/026* (2013.01); *H04R 1/023* (2013.01); *H04R 1/025* (2013.01); *H04R 1/345* (2013.01); *H04R 2201/021* (2013.01); *H04R 2201/025* (2013.01); *H04R 2400/11* (2013.01)

(58) Field of Classification Search

CPC ..... H04R 1/026; H04R 1/025; H04R 1/023; H04R 1/345; H04R 1/32; H04R 1/323; H04R 2201/021; H04R 2201/025; H04R 2400/11

See application file for complete search history.

(56) References Cited

U.S. PATENT DOCUMENTS 3,719,250 A * 3/1973 Maekawa ..... H04R 1/02 181/153
4,182,429 A * 1/1980 Senzaki ..... H04R 1/24 181/141
4,365,114 A * 12/1982 Soma ..... H04R 1/323 181/144
5,193,119 A * 3/1993 Tontini ..... H04R 1/24 381/182
5,319,164 A * 6/1994 Shen ..... H04R 1/025 181/150
5,512,714 A * 4/1996 Fenton ..... H04R 1/24 181/144
5,739,480 A * 4/1998 Lin ..... H04R 1/24 181/144
6,026,927 A 2/2000 Burdett et al.
6,070,694 A 6/2000 Burdett et al.
6,095,278 A * 8/2000 Lin ..... H04R 9/06 181/148
6,101,262 A 8/2000 Haase et al.
(Continued)

*Primary Examiner* — Edgardo San Martin
(74) *Attorney, Agent, or Firm* — Kirk A. Buhler; Buhler & Associates

(57) ABSTRACT

Improvements to an adjustable speaker within a frame is disclosed. The adjustment of the speaker allows for rotation or pivoting on a plurality of webs, ribs or fingers. The plurality of webs, ribs or fingers provide a plurality of bearing surfaces. The webs, ribs or fingers provide an open frame that requires less material and allows for sound transmission both in-front of the speaker and around the speaker. The frame can be scaled to be larger or smaller to accommodate different diameter and depth speakers. It is also contemplated that speakers frame can be accommodate both round and oblong shapes. The frame is a clam-shell mesh. The clam-shell captures the speaker between the two components. The two components essentially snap together to secure the speaker. The webs, ribs or fingers frame allows pivoting with a compression or tension member of a spring.

20 Claims, 5 Drawing Sheets

(56) References Cited

U.S. PATENT DOCUMENTS

| | | | | |
|---|---|---|---|---|
| 6,356,640 | B1 * | 3/2002 | Lin | H04R 1/24 181/144 |
| 6,792,125 | B1 * | 9/2004 | David | H04R 1/025 381/152 |
| 7,178,628 | B2 | 2/2007 | Gordon | |
| 7,997,381 | B2 | 8/2011 | Gordon | |
| 8,213,669 | B2 * | 7/2012 | Lin | H04R 1/323 181/186 |
| 8,229,155 | B2 * | 7/2012 | Maurer | H04R 1/025 181/144 |
| 8,243,963 | B2 * | 8/2012 | Gladwin | H04R 9/063 381/182 |
| 8,259,980 | B2 * | 9/2012 | Maurer | H04R 1/323 181/153 |
| 9,860,630 | B2 * | 1/2018 | Strange | H04R 1/26 |

* cited by examiner

ADJUSTABLE SPEAKER FRAME

CROSS REFERENCE TO RELATED APPLICATIONS

Not Applicable

STATEMENT REGARDING FEDERALLY SPONSORED RESEARCH OR DEVELOPMENT

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a pivoting frame for a speaker. More particularly, the present pivoting frame is created from interwoven fingers or web that allow for restrained pivotal movement of a speaker within the frame that allows the direction of a speaker to be altered.

Description of Related Art Including Information Disclosed Under 37 CFR 1.97 and 1.98

Depending upon the frequency being emitted, a sound from a speaker can vary from omni-directional to fairly uni-directional. Low frequency sounds are more omni-directional than higher frequency sounds. Because of this directionality, speakers that produce higher frequencies sounds can be placed in a speaker housing that allows the firing direction of the speaker to be adjusted to optimize where the sound can be best heard by the user. A number of patents and or publications have been made to address these issues. Exemplary examples of patents and or publication that try to address this/these problem(s) are identified and discussed below.

U.S. Pat. No. 6,026,927 issued on Feb. 22, 2000 and U.S. Pat. No. 6,070,694 that issued on Jun. 6, 2000, both to Albert Burdett et al disclose a Speaker Assembly. The speaker assembly has a sound driver sub-baffle assembly which can be pivoted forward and backward, as well as rotated clockwise or counter-clockwise 360 degrees via the use of a rotatable turntable mounted within the speaker's baffle. In these patents, a spring pushes a speaker held in a convex arc sector against a concave a frame. These patents do not use an interwoven web for constrained movement of the speaker. The nature of the web does not allow for sound to be transmitted through the frame members.

U.S. Pat. No. 7,178,628 issued on Feb. 20, 2007 to Ryan Gordon and U.S. Pat. No. 7,997,381 that issued on Aug. 16, 2011, both to Ryan Gordon disclose a Speaker Assembly with a pivoting panel-mount speaker assembly comprises a speaker housing. The speaker housing has a perimeter flange portion, an exterior housing wall extending rearwardly from the perimeter flange portion, and an interior curved track extending rearwardly from the perimeter flange portion. The interior curved track has an outward facing convex surface and an inward facing concave surface. These patents also use solid concave and convex surfaces with a tension spring that maintains pressure between the two components.

U.S. Pat. No. 6,101,262 issued Aug. 8, 2000 to Edward H. Haase discloses a Flush-mounted Pivoting Speaker. The panel mount speaker system includes a housing having flange and wall portions, a locating portion defining a primary and secondary support surface as a concave annular spherical segment. This configuration allows for semi-independent adjustment of coaxially mounted speakers but the speakers are held in mating concave/convex shells.

What is needed is an adjustable speaker frame that does not reply on springs or other tensioning mechanism to maintain pressure on the components. The proposed adjustable speaker frame disclosed in this document provides the solution with a plurality of ribs, web or frame elements.

BRIEF SUMMARY OF THE INVENTION

It is an object of the adjustable speaker frame to accommodate different size speakers. Speakers can come in a variety of diameters and a variety of depths. The frame can be scaled to be larger or smaller to accommodate different diameter and depth speakers. Generally, the speaker is for higher frequency sounds. It is also contemplated that speakers that can be accommodated on both round and oblong shapes can be retained within the frame.

It is an object of the adjustable speaker frame to allow for rotation or pivoting with a plurality of webs, ribs or fingers. The webs, ribs or fingers provide an open frame that requires less material and allows for sound transmission both in-front of the speaker and around the speaker. A solid back housing can be incorporated to create a sonic chamber for resonance.

It is another object of the adjustable speaker frame to clamp a speaker with the frame of the housing. One portion of the frame is a clam-shell mesh. The clam-shell captures the speaker between the two components. The two components essentially snap together to secure the speaker. The components can also be bonded to prevent the speaker from dislodging from the housing. A spring provides tension between the components to maintain the position of the speaker.

It is still another object of the adjustable speaker frame to provide pivoting in all directions. The plurality of webs, ribs or fingers provide a plurality of bearing surfaces. Because this is an open frame with plurality of webs, ribs or fingers, the interwoven plurality of webs, ribs or fingers allows for the plurality of webs, ribs or fingers to slide within and around each other thereby allowing the firing direction of the speaker to be adjusted within the limitations provided by the interwoven members. The rotation and amount of pivot is limited by the distance between the ribs and the quantity/placement of the ribs and the curvature of the ribs.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
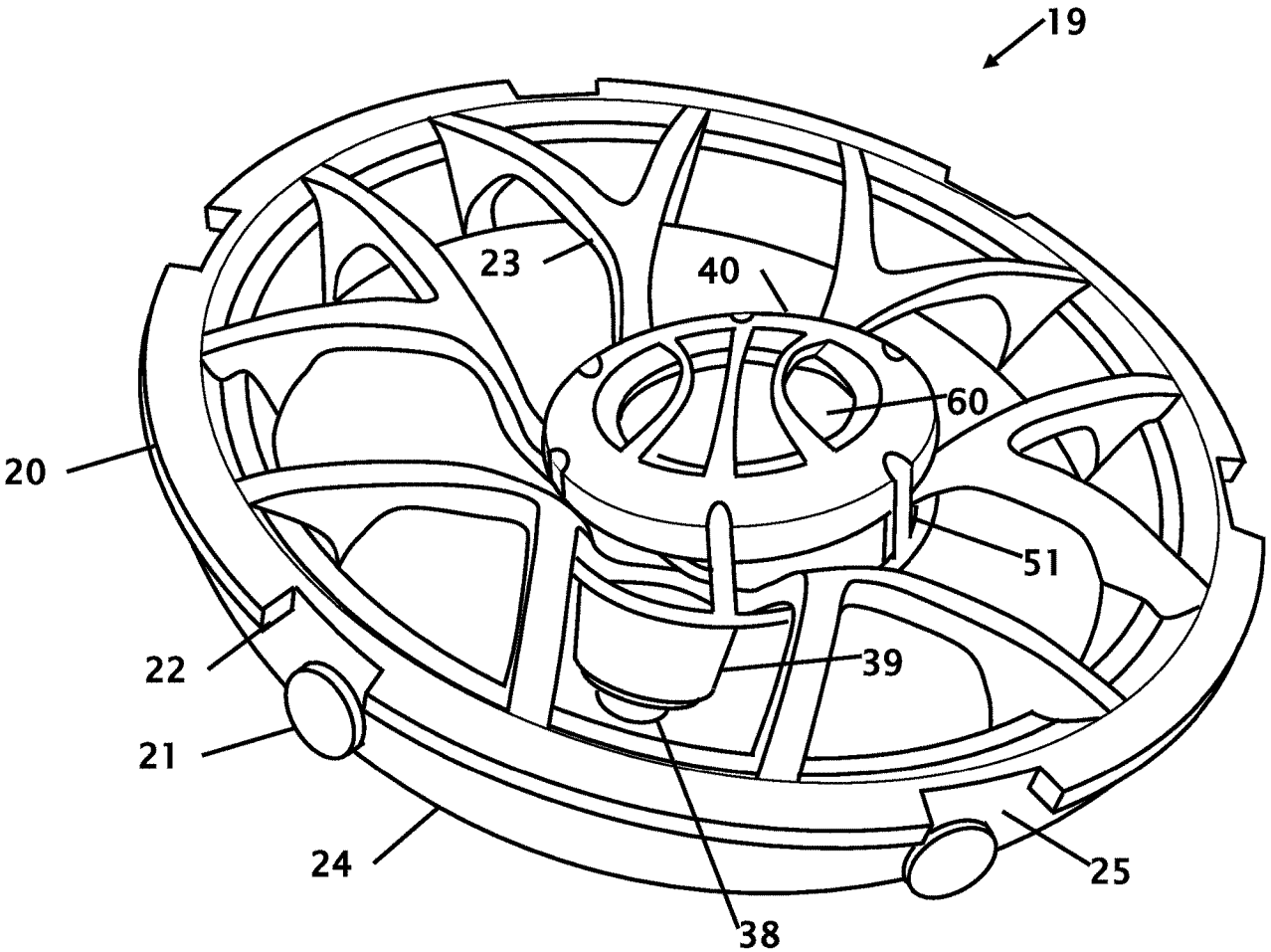
FIG. 1 shows a perspective view of the adjustable speaker frame.

FIG. 1 shows a perspective view of the adjustable speaker frame 19. The adjustable speaker frame 19 is essentially fabricated as an injection molded part, but other materials and manufacturing methods are contemplated that provide equivalent or superior performance. The adjustable speaker frame 19 is assembled from two sub-assemblies of an outer frame 20 and an inner cage 40. The outer frame 20 mounts to a speaker enclosure. In this embodiment, a plurality of studs or bosses 21 exist around the outer frame wall 24. In this embodiment six stubs 21 extend from the outer frame wall 24. It is contemplated that as few as two studs 21 to many more than six can be incorporated into the frame 20. A clearance 25 exists above the stubs 21. The stubs 21 fit into bayonet slots in a housing or speaker box (shown in other figures) where the adjustable speaker frame 19 mounts. An outer flange 22 extends around the outer frame wall 24.

The adjustable speaker frame 19 has a plurality of webs, ribs or fingers 23 that extend from the outer frame 20. The plurality of webs, ribs or fingers 23 extend from the outer frame 20. They prove an open frame structure for transmission of sound and resonance. It is also contemplated that the opening can be calculated to provide a tuned port for sound from a sub-woofer. The plurality of webs, ribs or fingers 23 extend to an inner hub that forms into a supporting tube 39 and to a port 38 where wiring can exit the adjustable speaker frame 19. An inner pivoting speaker 60 is secured in a separate housing 40 that pivots in the outer frame 20.

The inner frame 40 is assembled together around and through the plurality of webs, ribs or fingers 23 extend from the outer frame 20 to the inner hub. The inner frame is an assembly having a rear ring with fingers 51 that secure the inner frame onto the front face of the front ring. A rear backing ring (not shown in this figure) is retained between the inner frame 40 housings. A spring or other tensioning mechanism pushes between the outer frame 20 and the inner frame to maintain pressure between the two housing components to maintain the speaker in the desired firing direction, but still allows the inner frame to manipulate, to pivot and/or tilt the inner frame on the outer frame.

Figure 2:
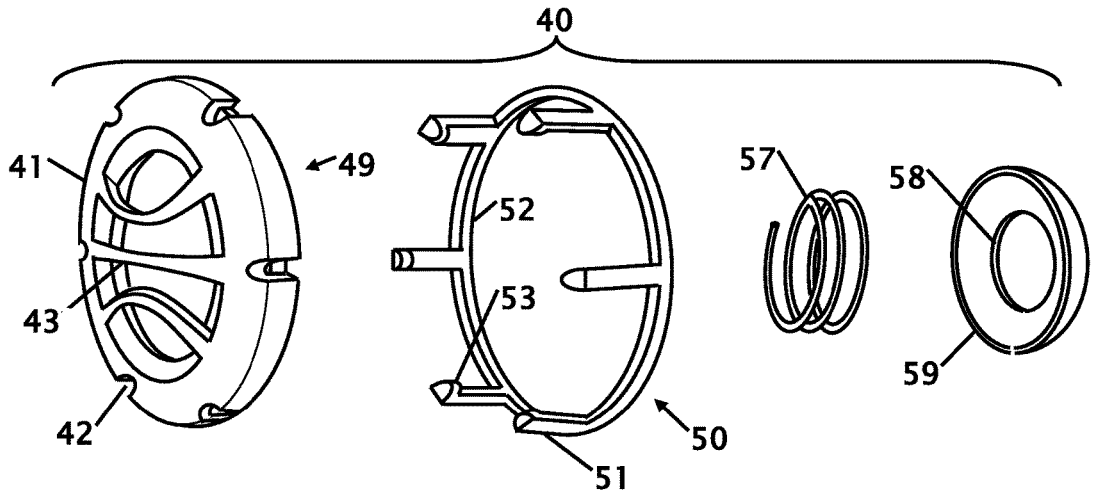
FIG. 2 shows an exploded view of the speaker frame.

FIG. 2 shows an exploded view of the speaker frame 40. This exploded view shows the pieces without a speaker. The speaker would normally be clamped between the front grill 49 and the spring 57. The front grill 40 has an outer rim 41 with grill elements 43 that both protect the cone or dome of the speaker and allow for transmission of sound through the grill 43. While a particular number and shape of grill elements are shown, other shapes and configurations are contemplated. It is also contemplated that the grill 43 can have ribs that direct or diffuse the sound from the speaker. The exterior of the front grill has a plurality of recesses or detents for securing the rear ring 50.

The rear ring 50 has a ring 52 with a plurality of finger 51 that terminate with tabs 53 that hook and secure the rear ring 50 in the recesses 42 in the front grill 49. The finger 51 extend through the plurality of webs, ribs or fingers 51 of the outer frame (not shown in this figure). A rear dome 59 with a wiring hole 58. The spring 57 pushes between the rear of a speaker (not shown) and the rear dome 59. The outer convex shape of the rear dome conforms to a concave shape in the outer frame 20.

Figure 3:
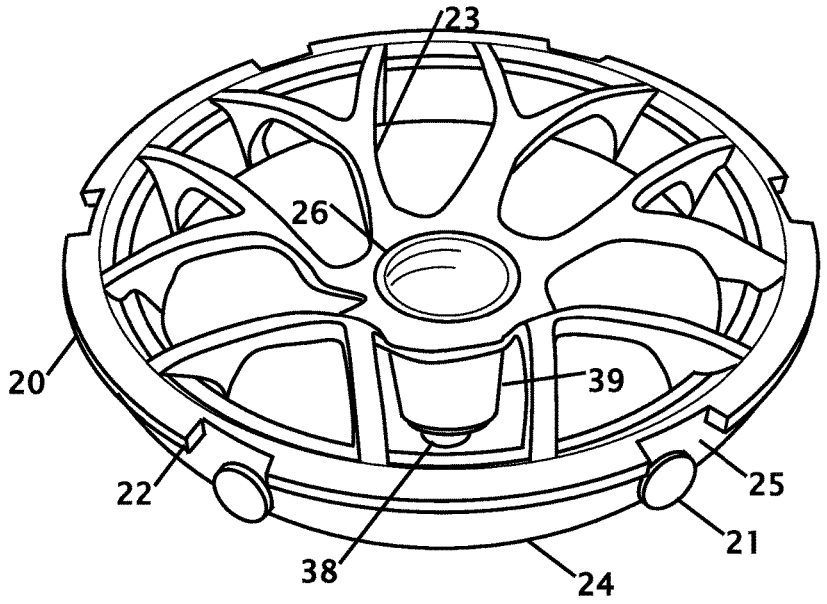
FIG. 3 shows a perspective view of the support housing.

FIG. 3 shows a perspective view of the outer frame 20 support housing. The outer frame 20 mounts to a speaker enclosure. A plurality of studs or bosses 21 exist around the outer frame wall 24. In this embodiment six stubs 21 extend from the outer frame wall 24. It is contemplated that as few as two studs 21 to many more than six can be incorporated into the frame 20. A clearance 25 exists above the stubs 21. The stubs 21 fit into bayonet slots in a housing or speaker box where the adjustable speaker frame 19 mounts. The speaker frame is simply inserted into an opening in a speaker box and rotated to secure the adjustable speaker frame. An outer flange 22 extends around the outer frame wall 24.

The adjustable speaker frame 19 has a plurality of webs, ribs or fingers 23 that extend from the outer frame 20. The plurality of webs, ribs or fingers 23 extend from the outer frame 20. They provide an open frame structure for transmission of sound and resonance. It is also contemplated that the opening can be calculated to provide a tuned port for sound from a sub-woofer. The plurality of webs, ribs or fingers 23 extend to an inner hub that forms into a supporting tube 39 and to a port 38 where wiring can exit the adjustable speaker frame 19. Inside of the support tube is a flat or concave surface 26 that supports the rear dome that is shown and described in other figures herein.

Figure 4:
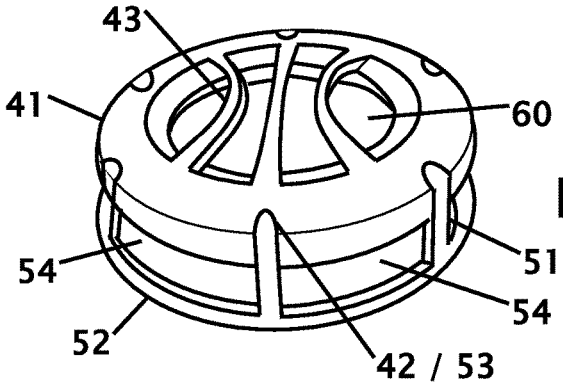
FIG. 4 shows a perspective view of a speaker in the retaining frame.

FIG. 4 shows a perspective view of a speaker 60 in the retaining frame. The speaker 60 is clamped between the front grill 43 and the rear ring 52. The front grill has an outer rim 41 with grill elements 43 that both protects the cone or dome of the speaker and allows for transmission of sound through the grill 43. It is also contemplated that the grill 43 can have ribs that direct or diffuse the sound from the speaker. The exterior of the front grill has a plurality of recesses or detents for securing the tabs 53 in recesses 42. The webs, fingers or ribs of the 23 of the outer frame 20 (not shown in this figure) fits through openings 54 where the webs, fingers or ribs of the 23 pass through these openings to maintain the speaker in the center of the outer frame and also allow the speaker to pivot, and turn to a limited degree.

Figure 5:
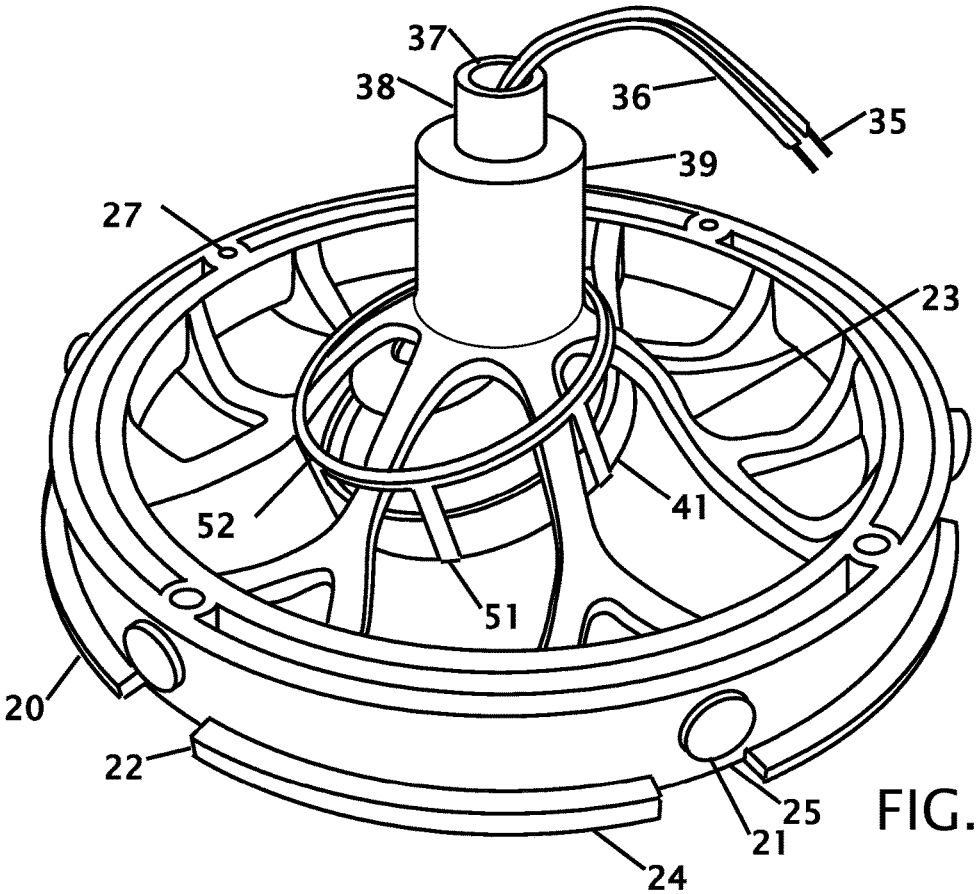
FIG. 5 shows an under-side view of the adjustable speaker frame.

FIG. 5 shows an under-side view of the adjustable speaker frame. The majority of the components in this figure have been previously described herein. In this view the webs, fingers or ribs of the 23 are shown passing through the ring of the speaker securing housing. This rear view further shows a plurality of holes 27 for mounting the outer frame or for securing a cone that seals the rear of the adjustable speaker frame 19 to prevent contamination or to tune the resonance volume. The rear end of the housing has an opening 37 where wiring 36 and conductors 35 to provide a connection to a secured speaker for the transmission of sound.

Figure 6:
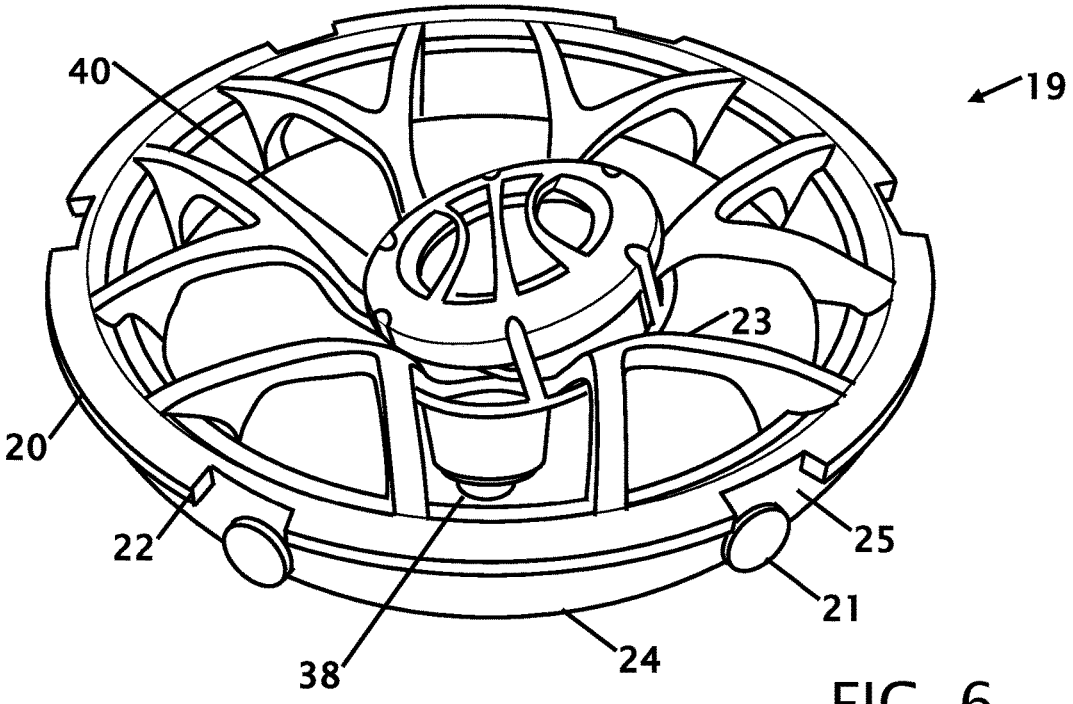
FIG. 6 shows the speaker tilted left.
Figure 7:
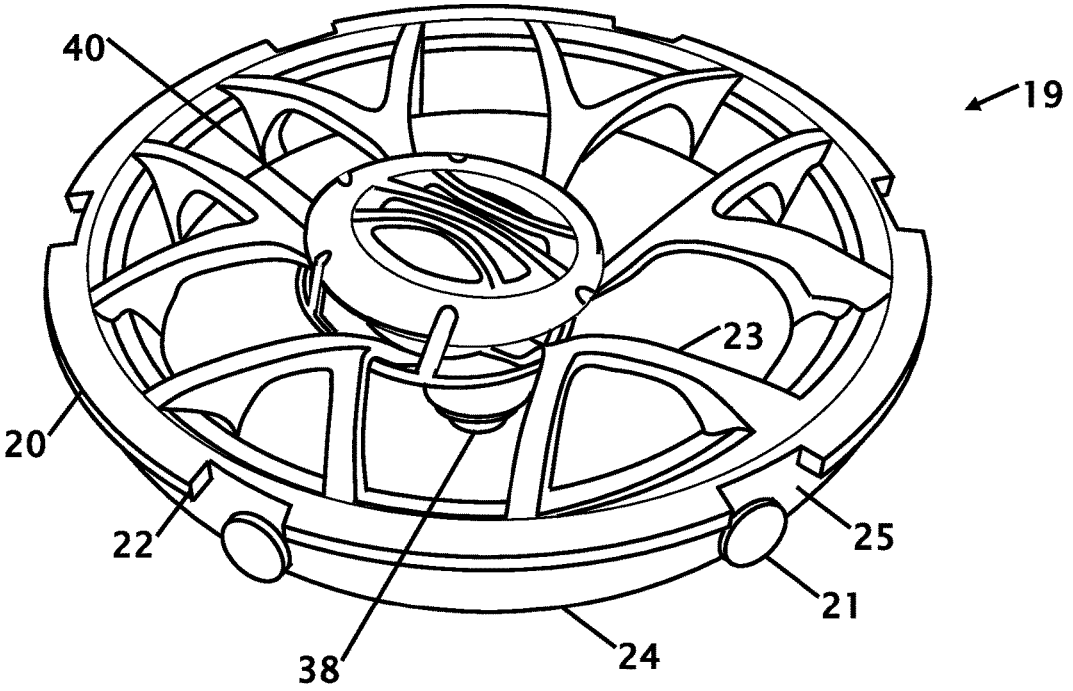
FIG. 7 shows the speaker tiled right.

FIG. 6 shows the speaker tilted left and FIG. 7 shows the speaker tiled right. These figures show the approximate amount of angular adjustment that can be made to the speaker relative to the outer frame 20. While these figures represent small speakers or tweeters, the adjustable speaker frame 19 can be scaled to accommodate much larger speakers.

Figure 8:
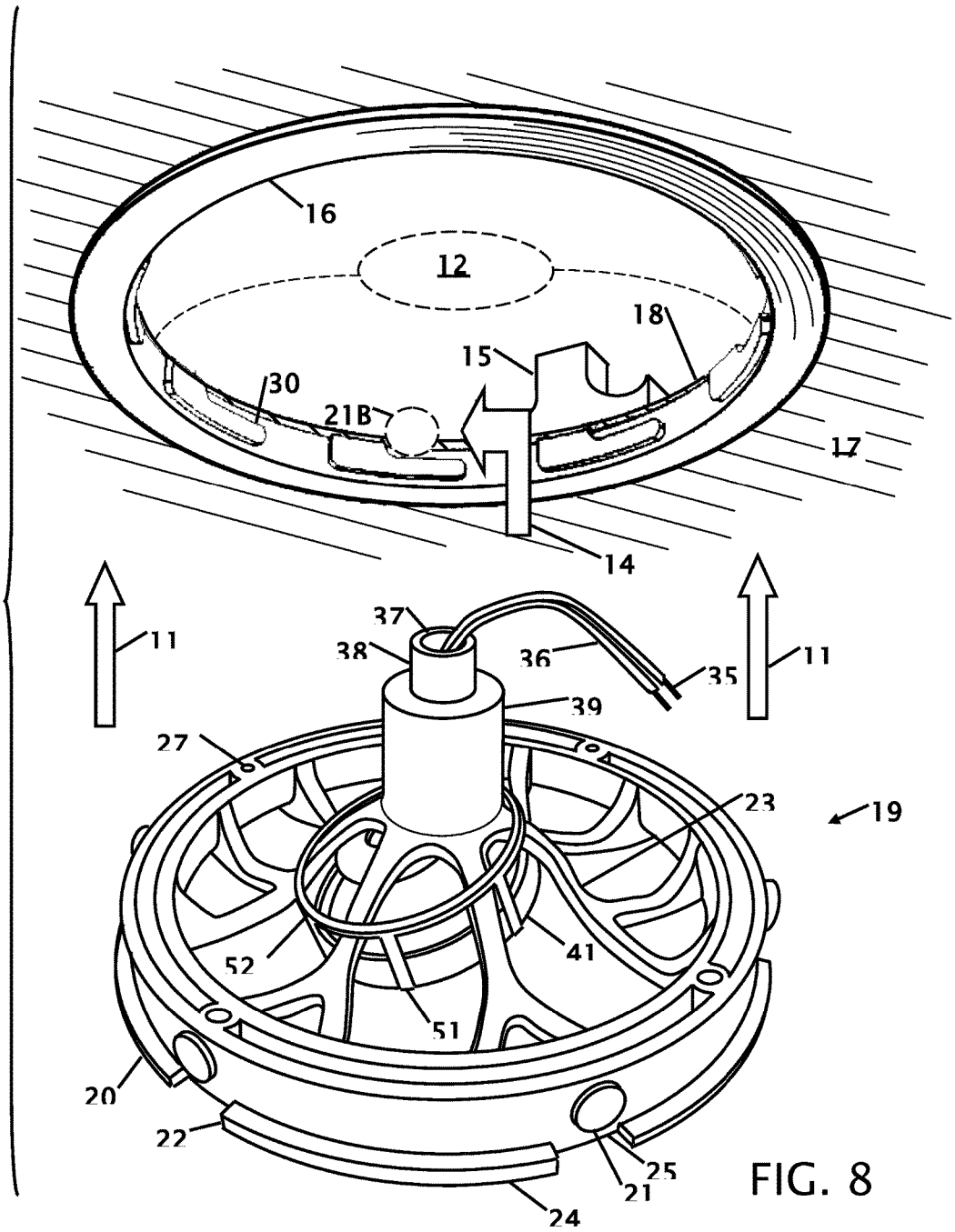
FIG. 8 shows a perspective of the fixture housing for recessed base speaker pressed in the retaining housing.

FIG. 8 shows a perspective of the fixture housing for recessed base speaker 12 pressed in the retaining housing 16. In this figure a speaker 12 is shown to represent a base, woofer, mid-range or full range speaker 12 that is in a housing 16 installed in a wall 17 or in a speaker housing. The retaining 16 is retained in the wall 17 with fasteners 15 or other mechanism that hold the retaining housing 16 between the front 17 and the rear 18 of the wall or enclosure. The retaining housing 16 has two or more tabs or ears 30. The stubs 21 retain the adjustable speaker frame 19 by lifting 11 the adjustable speaker frame 19 up and rotating 14 the adjustable speaker frame 19 in the retaining housing 16.

The housing shows a phantom stub 21B retained on one of the ears 30. The outer flange 22 of the adjustable speaker frame 19 is contact with the underside of the tabs or ears 30 with a slight compression fit to retain the adjustable speaker frame 19 and prevent vibration or buzzing when the speaker (s) vibrate. The adjustable speaker frame 19 can be removed by rotating the adjustable speaker frame 19 in the opposite direction to release the stub 21B from the ears 30. The adjustable speaker frame 19 can then be moved away from the retaining housing 16. While the adjustable speaker frame 19 is installed in the retaining housing 16 the assembled inner cage 40 can be rotated and articulated relative to the outer frame 20.

Thus, specific embodiments of an adjustable speaker frame have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. An adjustable speaker frame comprising:

a first frame having an outer supporting rim;

said first frame having an inner hub;

a plurality of curved webs, ribs or fingers extending from said outer supporting rim to said inner hub whereby creating an open cage;

said inner hub having a concave surface;

a second frame having at least two clam shell parts whereby said at least two clam shell parts are secured through a front and a back side of said first frame;

a mount for a speaker between said at least two clam shell parts, and a convex disc under pressure of a spring between said second frame and said inner hub having a concave surface.

2. The adjustable speaker frame according to claim 1 wherein there are at least three curved webs, ribs or fingers extending from said outer supporting rim to said inner hub.

3. The adjustable speaker frame according to claim 2 wherein there are at least three curved webs, ribs or fingers on at least one of said at least two clam shell parts.

4. The adjustable speaker frame according to claim 1 wherein said second frame pivots within said first frame.

5. The adjustable speaker frame according to claim 1 wherein said second frame slides within said first frame.

6. The adjustable speaker frame according to claim 1 further includes a plurality of stubs that extend from said outer supporting rim.

7. The adjustable speaker frame according to claim 6 wherein said plurality of stub engage in a retaining housing.

8. The adjustable speaker frame according to claim 1 wherein said inner hub extends to a supporting tube.

9. The adjustable speaker frame according to claim 8 wherein said convex disk is supported on said inner hub.

10. The adjustable speaker frame according to claim 1 further includes a speaker retained within said second frame.

11. An adjustable speaker frame comprising:

a first frame having an outer supporting rim;

said first frame having an inner hub;

a plurality of webs, ribs or fingers extending from said outer supporting rim to said inner hub;

a second frame having at least a top housing and a bottom housing whereby said top housing and said bottom housing are secured through a front and a back side of said first frame;

a mount for a speaker between said top housing and said bottom housing, and a compression mechanism between said second frame and said inner hub.

12. The adjustable speaker frame according to claim 11 wherein there are at least three curved webs, ribs or fingers extending from said outer supporting rim to said inner hub.

13. The adjustable speaker frame according to claim 12 wherein there are at least three webs, ribs or fingers on said top housing or said bottom housing of said second frame.

14. The adjustable speaker frame according to claim 11 wherein said second frame articulates on said first frame.

15. The adjustable speaker frame according to claim 11 wherein said second frame slides within said first frame.

16. The adjustable speaker frame according to claim 11 further includes a plurality of stubs that extend from said outer supporting rim.

17. The adjustable speaker frame according to claim 16 wherein said plurality of stub engage in a retaining housing.

18. The adjustable speaker frame according to claim 11 wherein said inner hub extends to a supporting tube.

19. The adjustable speaker frame according to claim 11 further includes a speaker retained within said second frame.

20. The adjustable speaker frame according to claim 19 wherein said compression member supports said speaker in said first frame and said second frame.

* * * * *